US005938056A

United States Patent [19]

Ma

[11] Patent Number: 5,938,056

[45] Date of Patent: Aug. 17, 1999

[54] ARTICULATED HINGED CLOSURE

[75] Inventor: Xiaoli Ma, San Jose, Calif.

[73] Assignee: Crown Cork & Seal Technologies Corporation, Alsip, Ill.

[21] Appl. No.: 08/808,969

[22] Filed: Feb. 19, 1997

Related U.S. Application Data

[ 60] Provisional application No. 60/012,012, Feb. 21, 1996.

[51] Int. Cl.[6] ..... B65D 39/00

[52] U.S. Cl. ..... 215/237; 220/254; 220/339

[58] Field of Search ..... 215/235, 237, 215/238; 220/254, 283, 285, 339

[56] References Cited

U.S. PATENT DOCUMENTS

| | | | |
|---|---|---|---|
| 4,327,842 | 5/1982 | Walter | 220/367 |
| 4,344,545 | 8/1982 | Aschberger et al. . | |
| 4,356,924 | 11/1982 | Walter | 215/237 |
| 4,361,244 | 11/1982 | Walter | 215/253 |
| 4,369,888 | 1/1983 | Walter . | |
| 4,414,705 | 11/1983 | Ostrowsky . | |
| 4,462,504 | 7/1984 | Roth et al. . | |
| 4,519,517 | 5/1985 | Walter | 215/253 |
| 4,778,072 | 10/1988 | Newman . | |
| 4,787,525 | 11/1988 | Joyce | 215/201 |
| 4,795,044 | 1/1989 | Beck . | |

*Primary Examiner*—Stephen K. Cronin
*Attorney, Agent, or Firm*—Woodcock Washburn Kurtz Mackiewicz & Norris LLP

[57] ABSTRACT

An articulated hinged closure includes a lid adapted to be attached to a wide-mouthed container. The lid has a pouring aperture and a peripheral rim surrounding the aperture, which is initially plugged by a sealing member having upper and lower leaves interconnected by an integral articulated connector. The connector is a link having opposed upper and lower ends, and a flexible hinge at either end, the upper of said hinges connecting the link to the upper leaf, and the lower of said hinges connecting the link to the lower leaf. Each of said hinges is designed so that a respective end of the link binds against adjacent structure in such a-way that, as the lid is opened, the upper hinge eventually binds against the upper leaf, causing the lower hinge to pivot and bind againstr the lid and until it pries the plug out of the aperture.

1 Claim, 2 Drawing Sheets

ARTICULATED HINGED CLOSURE

This application claims the benefit of U.S. Provisional Application No. 60/012,012, filed Feb. 21, 1996.

BACKGROUND OF THE INVENTION

This invention relates to the art of closures, and more particularly to a cap or lid for a bottle or can.

Prior inventors have proposed a number of all-plastic resealable closures having pull tabs or levers which can be raised to open the closure. U.S. Pat. No. 4,462,504 discloses a hinged cap construction having three portions: a ring-like base member that engages the container mouth, a closure plug which snaps into the ring's opening, and a top portion that seals a vent hole in the closure, and has a pull tab. One lifts the tab first to vent the container and then open the closure. U.S. Pat. No. 4,369,888 discloses a similar arrangement, where the rim of the closure has a raised fulcrum post so that the pull tab of lever, when opened 180°, pries the plug out of its seated position.

Other pertinent prior patents include U.S. Pat. No. 4,344,545, U.S. Pat. No. 4,778,072, U.S. Pat. No. 4,414,705, and U.S. Pat. No. 4,795,044.

SUMMARY OF THE INVENTION

An object of the invention is to provide a resealable closure for a bottle, can or other container, where the closure plug is formed on one of two leaves, the other of which functions as a lever to pry to plug out of the container mouth.

Yet another object of the invention is to facilitate assembly of the closure and lid.

These and other objects are attained by an articulated hinged closure including a lid adapted to be attached to a container. The lid has a pouring aperture and a peripheral rim surrounding the aperture, which is initially plugged by a sealing member having upper and lower leaves interconnected by an integral articulated connector. The connector is a link having opposed upper and lower ends, and a flexible hinge at either end, the upper of said hinges connecting the link to the upper leaf, and the lower of said hinges connecting the link to the lower leaf. Each of said hinges is designed so that a respective end of the link binds against adjacent structure in such a way that, as the lid is opened, the upper hinge eventually binds against the upper leaf, causing the lower hinge to pivot until it binds against the lid and pries the plug out of the aperture.

BRIEF DESCRIPTION OF THE DRAWINGS

In the accompanying drawings.

DESCRIPTION OF THE PREFERRED EMBODIMENT

Figure 1:
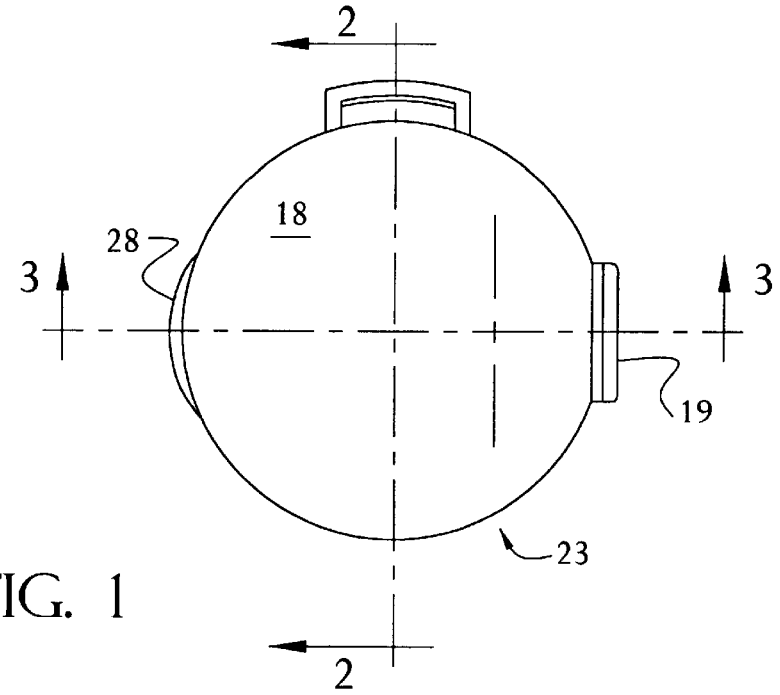
FIG. 1 is a top plan view of an articulated hinged closure embodying the invention.
Figure 3:
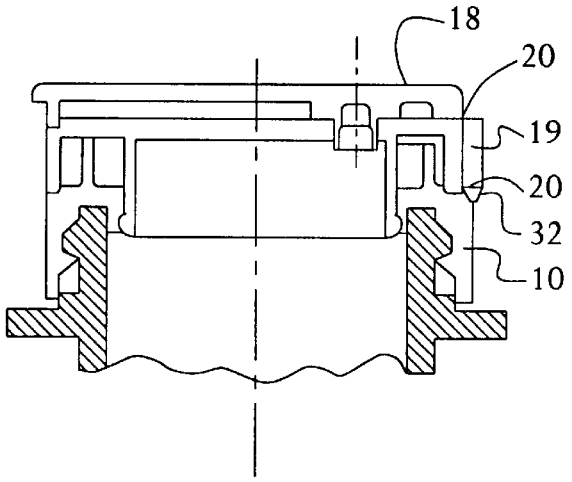
FIG. 3 is a sectional view thereof, taken on the plane 3—3 in FIG. 1.

A resealable closure embodying the invention is shown in FIGS. 1–6. The closure comprises a lid 10, adapted to fit on and be permanently secured to the finish of a bottle or the top of a can or other container, and a removable sealing member 12 for sealing the lid's pouring aperture 14. The sealing member comprises two leaves 16,18 interconnected by a link 19 having an integral molded ("living") hinge 20 at either end. The upper hinge connects the link to the upper leaf, while the lower hinge connects the link to the lower leaf. Each hinge is placed along the inboard edge of the link or close to the inboard edge of the link, so that it binds against the opposing structure at some point in its travel. The length of the link 19, i.e., the distance between the two hinges 20 corresponds to about the height of the outer circumferential (cylindrical) wall 23 of the leaf 16.

The sealing member's lower leaf 16, functioning as the closure's plug, has a downwardly protruding skirt 22, which snaps into the pouring aperture. Preferably, the skirt has a circumferential barb 24 at its bottom, to provide a predetermined retention force within the pouring aperture 14, sufficient to resist anticipated internal container pressures. A small hole 26 in the lower leaf serves as a vent to relieve container pressure as the closure is opened.

Figure 2:
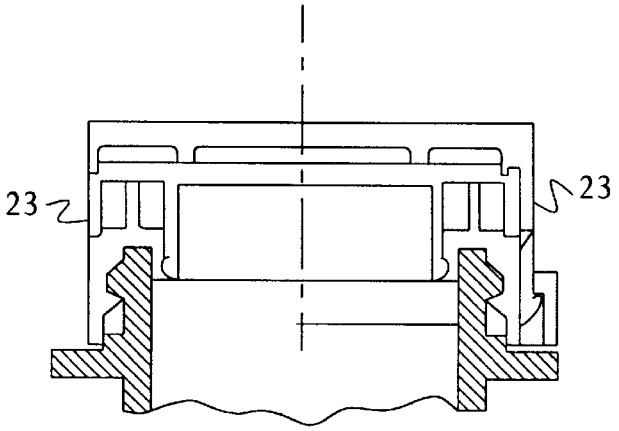
FIG. 2 is a sectional view thereof, taken on the plane 2—2 in FIG. 1.
Figures 4, 5, 6:
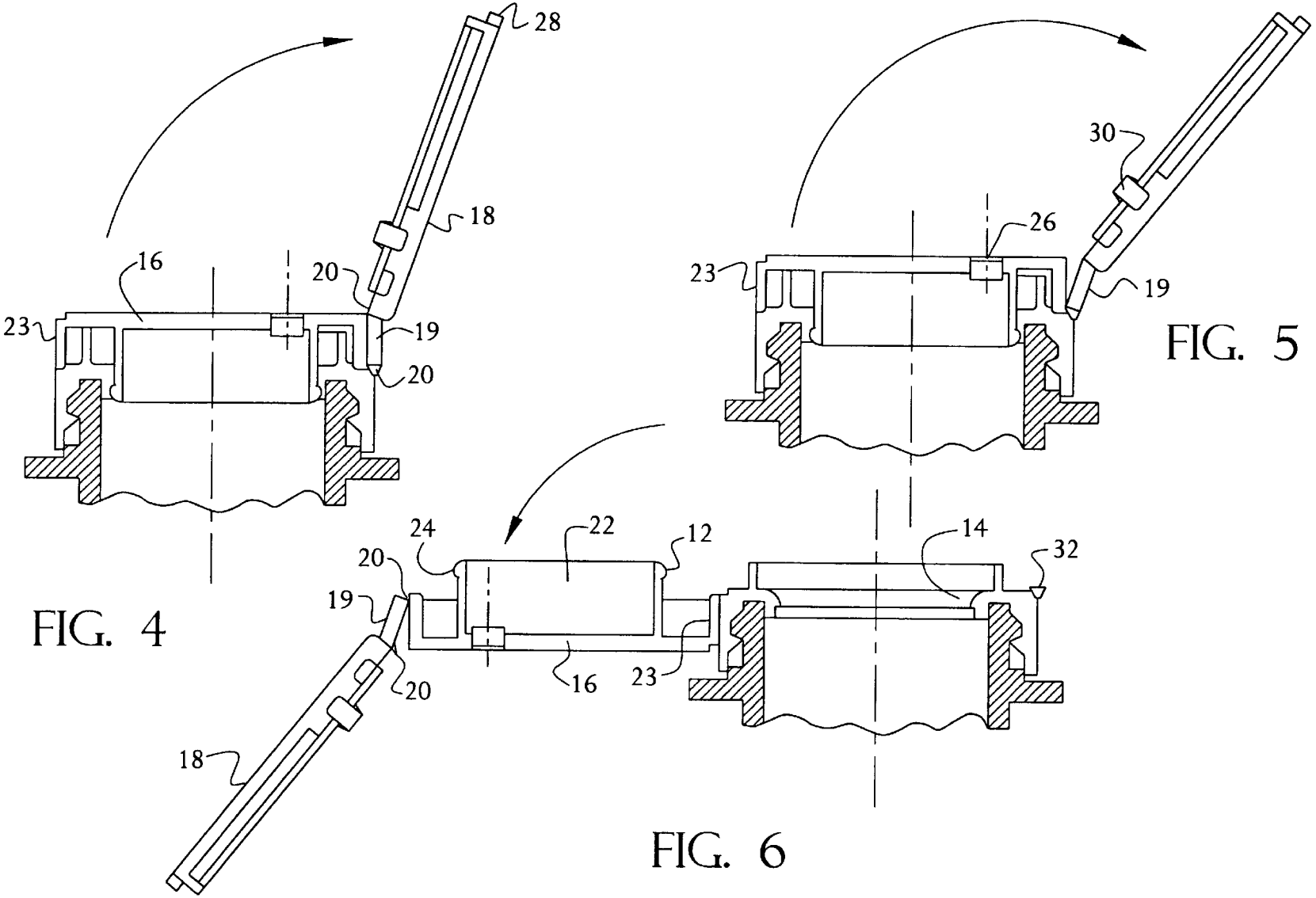
FIGS. 4, 5 and 6 are views like FIG. 3, showing progressive stages of closure opening.

The upper leaf 18 of the sealing member, when viewed from the side as in FIG. 2, is preferably longer than the lower leaf 16, thus providing a tab 28 that one can grasp.

The closure assembly is preferably made by injection molding or compression molding from a suitable plastic material such as polyethylene or polypropylene or co-polymers The lid may be installed in the top opening of a container by any suitable method, such as a conventional snap-on or screw-type capping head, for example.

To open the closure, one merely lifts the tab 28. The top leaf then is raised, withdrawing the vent pin 30 from the vent hole 26 to allow excess pressure to escape from the container. As the top leaf is moved past vertical, the upper end of the link abuts the periphery of the upper leaf, preventing further hinging movement. Now the lower hinge unfolds, but only slightly before the lower end of the link comes to bear against the shoulder 32 on the lid. Binding of the lower hinge produces a large mechanical advantage, prying the closure out of the pouring aperture. The closure may be resealed later.

The above description is of the best mode of the invention presently contemplated by the inventors. Certain details, however, are not critical to the invention, and it is expected that such details may be altered. For example, the lid could be connected to the container by threads, snap fitting flanges, adhesives, welding, or other means. The skirt 22 may either be in sealing contact with lid 10 or directly with the inner surface of the container mouth. It is also expected that materials other than those mentioned above may prove useful, or even preferable.

Since the invention is subject to modifications and variations, it is intended that the foregoing description and the accompanying drawings shall be interpreted as only illustrative of the invention defined by the following claims.

I claim:

1. An articulated hinged closure comprising a lid adapted to be attached to a container, said lid having a pouring aperture and a peripheral rim surrounding the aperture, said closure further comprising a sealing member having upper and lower leaves interconnected by an integral articulated connector comprising a link having opposed upper and lower ends, and a flexible hinge at either end, the upper of said hinges connecting the link to the upper leaf, and the lower of said hinges connecting the link to the lower leaf, the lower leaf having means for plugging the pouring aperture, each of said hinges being designed so that a respective end of the link binds against adjacent structure in such a way that, as the lid is opened the upper hinge eventually binds against the upper leaf, causing the lower hinge to pivot and bind against the lid until it pries the plugging means on the lower leaf out of the aperture.

* * * * *

UNITED STATES PATENT AND TRADEMARK OFFICE

CERTIFICATE OF CORRECTION

PATENT NO. : 5,938,056
DATED : August 17, 1999
INVENTOR(S) : Xiaoli Ma

It is certified that error appears in the above-identified patent and that said Letters Patent is hereby corrected as shown below:

Title page,
ABSTRACT,
Line 11, delete "a-way" and insert -- away -- therefor;
Line 14, delete "againstr" and insert -- against -- therefor;

Column 1,
Line 31, delete "to pry to plug" and insert -- to pry the plug -- therefor;

Column 2,
Line 31, delete "co-polymers The" and insert -- co-polymers. The -- therefor.

Signed and Sealed this

Second Day of April, 2002

*Attest:*

*Attesting Officer*

JAMES E. ROGAN
*Director of the United States Patent and Trademark Office*